United States Patent [19]

Crawford et al.

[11] Patent Number: 4,954,025

[45] Date of Patent: Sep. 4, 1990

[54] ANCHOR SET TOOL

[75] Inventors: Danny E. Crawford; Doug Rogge, both of Charles City, Iowa

[73] Assignee: Diversified Fastening Systems, Inc., Charles City, Iowa

[21] Appl. No.: 466,058

[22] Filed: Jan. 16, 1990

[51] Int. Cl.[5] ..... B25F 3/00

[52] U.S. Cl. ..... 408/238; 7/158; 7/165; 408/239 R

[58] Field of Search ..... 279/14; 408/117, 118, 408/119, 186, 199, 238, 239 R; 7/158, 165

[56] References Cited

U.S. PATENT DOCUMENTS

| | | | |
|---|---|---|---|
| 3,336,611 | 8/1967 | Schepp | 7/158 |
| 3,965,510 | 6/1976 | Ernst | 7/158 |
| 4,092,753 | 6/1978 | Fuhrmann | 7/158 |

FOREIGN PATENT DOCUMENTS

| | | | |
|---|---|---|---|
| 84665 | 3/1958 | Denmark | 7/165 |
| 304002 | 2/1989 | European Pat. Off. | 408/239 R |

*Primary Examiner*—Daniel W. Howell

*Attorney, Agent, or Firm*—G. Brian Pingel

[57] ABSTRACT

A tool adapted for use with a drill for installing screw anchors in concrete or masonry walls or the like having a sleeve type body, a bit holder slidably located in the body, a drill bit with a handle secured in the bit holder, a coil spring seated on a collar of the bit holder and extending around the bit, and a nut driver secured to the front end of the body. The bit holder is adapted to receive the bit handle and to also serve as a stabilizer for the bit and the coil spring. The nut driver is formed to guide the bit and to shield the front end of the bit from contact with drive members that may be secured in the nut driver.

4 Claims, 2 Drawing Sheets

ANCHOR SET TOOL

BACKGROUND OF THE INVENTION

1. Field of the Invention

The present invention relates in general to a tool adapted for use with a hand drill for installing screw anchors in concrete or masonry walls and more specifically relates to such tools that have an improved stability of components to increase tool operation and efficiency.

2. Description of the Prior Art

Anchor set tools having a general configuration similar to that of the present invention are known in the art. The general configuration of such known anchor set tools includes a sleeve type body in which a drill bit is retractably received, and there is a nut driver located on one end of the body. The bit holder is slidably located in the bore of the sleeve type body for receiving a handle of the drill bit and has a bit retention means that extends from one side through a slot in the body so that the drill bit can be positioned with respect to the body.

Although anchor set tools of the above general configuration have proved usual and efficient in comparison to prior methods of setting anchors, such prior devices have suffered from the deficiencies that affect their operational function. For example, in prior devices the drill bit is not sufficiently stabilized to prevent it from wobbling within the body bore. Similarly, the coil spring is subject to misalignment because of the lack of seating means for the ends of the spring. Prior devices also suffer the problem of the driver means being formed so that it is possible for the end of the drill bit to come in contact with a driver bit inserted in the driver means. The present invention is an improvement over the above described devices and eliminates the foregoing described deficiencies.

SUMMARY OF THE INVENTION

The present invention provides an improved tool adapted for use with a hand drill for installing screw anchors in concrete or masonry walls or the like. The invention includes a sleeve type body, a bit holder slidably located in the bore of the body, a drill bit secured in the bit holder, driver means secured to the front end of the body, and a coil spring through which said bit extends to serve as a biasing means for urging the bit in a rearward direction in the body bore.

The body includes a longitudinally aligned open slot that is associated with a retainer notch and at least one depth notch. The bit holder has a bit retention means that extends from one side of the holder through the slot in the body to serve as a guide for manually moving the bit with respect to the body during anchor installation. The bit holder is formed with a cavity for receiving the bit handle and also has a side wall that closely encircles a portion of said bit to prevent the bit from wobbling with respect to the holder.

The driver means has a head portion with a stair-stepped socket and a neck portion positioned in the bore of said body and having a passage way that extends from the bottom of the head socket and through the neck portion to open to said body bore for closely encircling the bit to serve as a bit guide means. The head socket of the driver means has a first recessed portion for receiving a driver bit and a second portion in which the front end of the drill bit can be located without contacting the driver bit.

DETAILED DESCRIPTION OF THE PREFERRED EMBODIMENT

Figure 1:
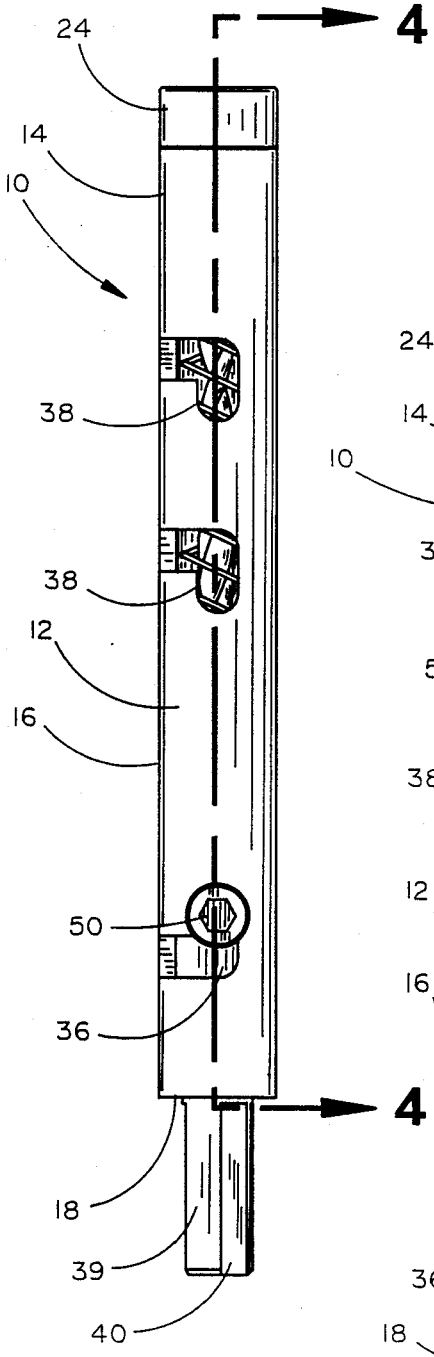
FIG. 1 is a side view in elevation of a preferred embodiment of an improved anchor set tool of the present invention that includes a sleeve type body for housing a retractable drill bit.

With reference to the drawings, the anchor set tool of this invention is indicated generally as 10 in FIG. 1, and includes a cylindrical, sleeve type, body 12, with a front end 14, a middle section 16, and a rear end 18. A drill bit 20 (FIGS. 3 and 4) is secured to a bit holder 22, which is slidably located in the body 12. A driver means 24 is secured to the front end 14 of the body 12, and a coil spring 26 serves as a biasing means to urge the bit holder 22 rearwardly in the body 12.

Figure 4:
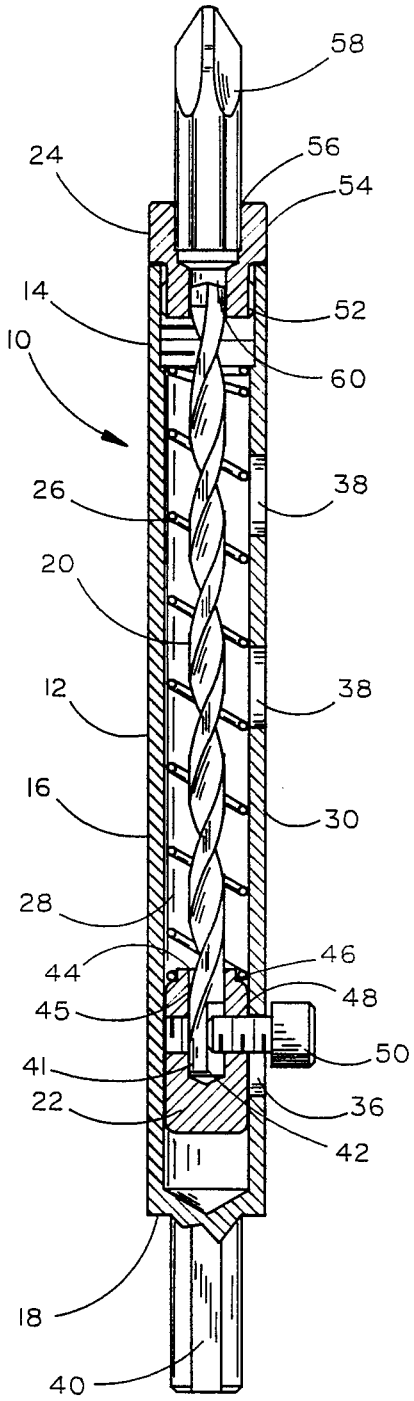
FIG. 4 is a cross-sectional view taken along the line 4-4 of FIG. 1.
Figures 3, 5, 6:
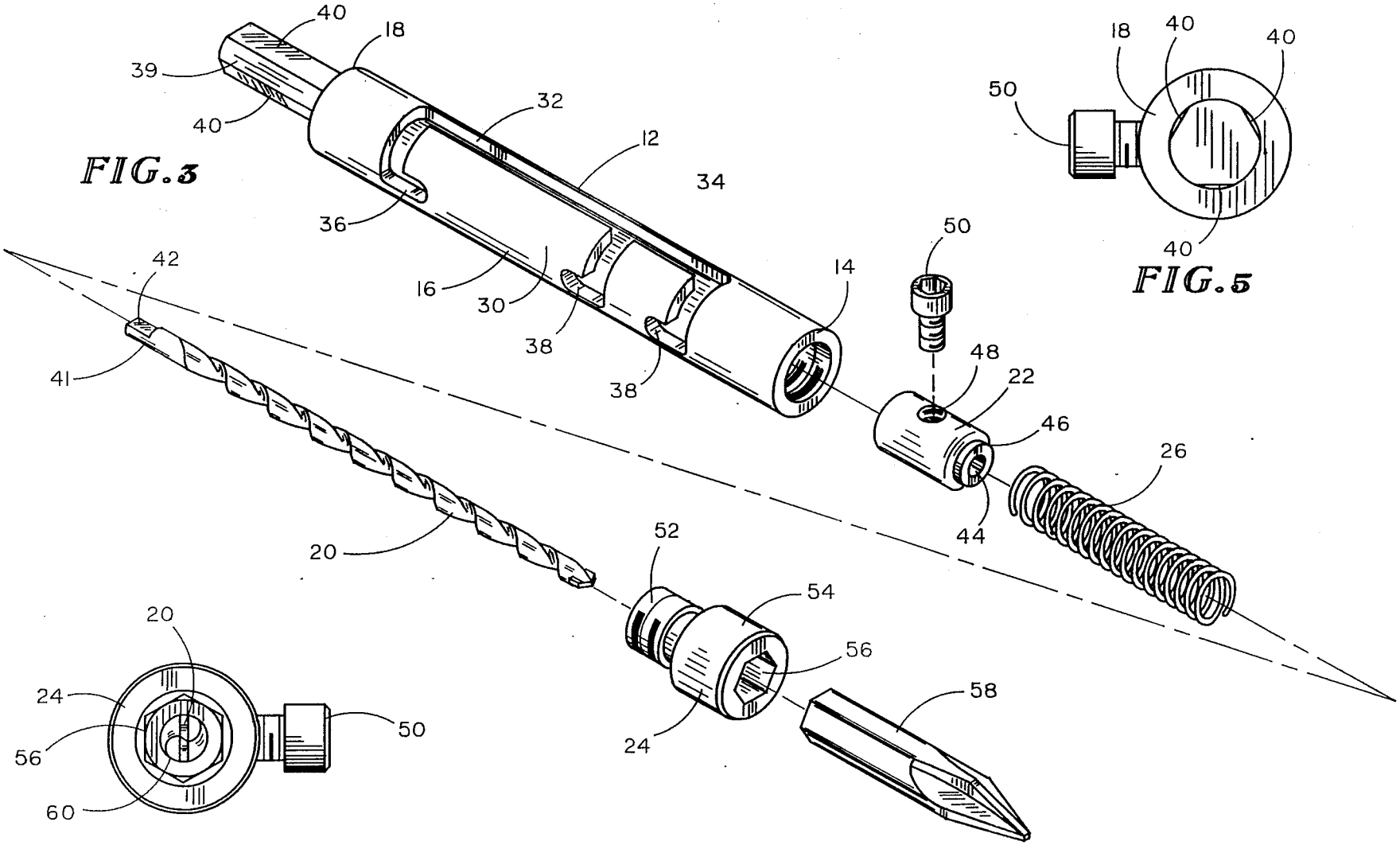
FIG. 3 is an exploded perspective view of the embodiment of FIG. 1 shown together with a driver bit that can be utilized with the present invention.
FIG. 5 is a bottom view of the embodiment of FIG. 1.
FIG. 6 is a top view of the embodiment of FIG. 1.

Referring to FIGS. 3 and 4, the front end 14 of the body 12 is threaded internally for a purpose to be described later. The middle section 16 of the body 12 is tubular in cross section consisting of a bore 28 and a wall 30. The wall 30 includes a cutout 32 consisting of a longitudinal slot 34, a retainer notch 36, and a pair of depth notches 38. The rear end 18 of the body 12 is formed of a generally cylindrical shape and, as best shown in FIG. 5, a handle 39 extends outwardly therefrom. The handle 39 has a plurality of flat surfaces 40 equally spaced radially for positive engagement with a three jaw chuck of a drill (not shown).

The drill bit 20 is of a conventional design for drilling masonry, concrete or the like and includes, at its handle end 41, a flat stepped portion 42 to be received into the bit holder 22.

The bit holder 22 is cylindrical in shape with its outside diameter sized to slide freely witin the bore 28 of the body 12. The holder is formed with a cavity 44 for receiving the handle end 41 of the drill bit 20 (FIGS. 3 and 4) and a sidewall 45 that closely encircles a portion of the bit 20 and prevents the bit from wobbling with respect to the holder 22. Adjacent the cavity 44 is an integral retainer collar 46 sized to accept one end of the coil spring 26 and serve as a seat therefor. Perpendicular to the cavity 44, and intersecting with it is a tapped hole 48 for receiving a retainer screw 50 for a purpose to be described later.

The driver means 24 is of a cylindrical shape with an externally threaded neck portion 52 which can be screwed into the body front end 14, and a drive end or head portion 54. Formed in the drive end 54 is a recessed, stair stepped hex drive socket 56 for receiving a standard screw driver bit 58, many shapes and sizes of which are readably available. Also formed in the driver means 24 is a throughbore 60 for passage of the drill bit 20. The throughbore 60 is smaller in diameter than the socket 56 so that the socket 56 and the throughbore 60 form a stairstepped configuration. The throughbore 60 is of a close enough fit to provide stability to the drill bit 20 when extended for drilling, and sufficiently long enough to ensure that, in the retracted position, the drill bit 20 will still be engaged in the throughbore 60, but will not contact the end of screw driver bit 58 when seated in the socket 56.

The anchor set tool 10 is assembled by inserting the drill bit 20 into the bit holder 22 so as to align the flat portion 42 directly under the tapped hole 4B (FIG. 4). This assembly is then slid into the bore 28 of the body 12 so that the tapped hole 48 is aligned with the longitudinal slot 34 of the cutout 32. The set screw 50 is then inserted through the slot 34, threaded into the tapped hole 48 and tightened down onto the flat portion 42 of the drill bit 20. Thus the drill bit 20 and the bit holder 22 are slidably retained in the bore 28 of the body 12. Next the coil spring 26 is slid over the drill bit 20 and is captured by the retaining collar 46 of the bit holder 22. Finally, the driver means 24 is screwed into the front end 14 of the body 12 to complete the assembly of the anchor set tool 10.

The coil spring 26 urges the bit holder 22 towards the rear end 18 of the body 12 where set screw 50 can be rotated to engage with the retainer notch 36 as shown in FIGS. 1 and 4. It will be noted, that while in this retracted position, the point of the drill bit 20 is contained by the throughbore 60 of the driver means 24, and is sufficiently retracted to as not to come in contact with the rear of the screw driver bit 58.

Figure 2:
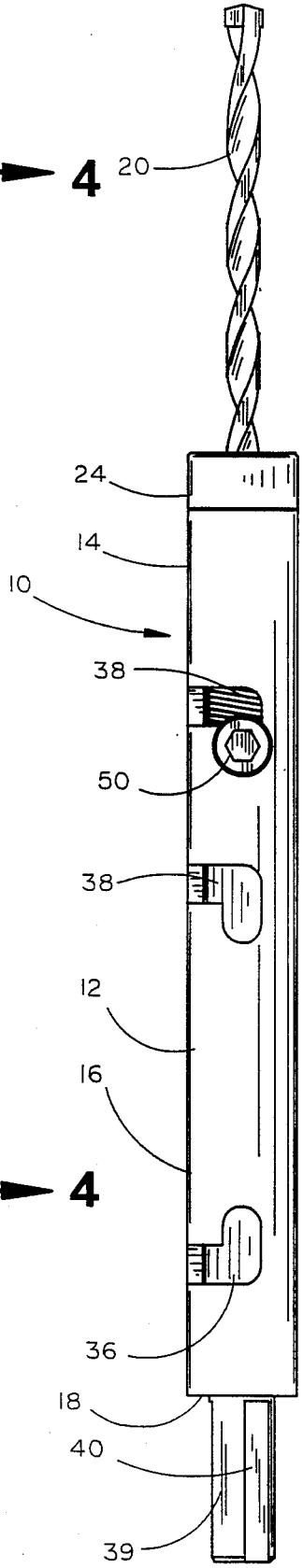
FIG. 2 is a view similar to that of FIG. 1 but with the drill bit of the preferred embodiment shown in an extended position.

With the screw driver bit 58 removed, the set screw 50 can be rotated out of engagement with the retainer notch 36 and slid along the slot 34 against the bias of the coil spring 26. Upon reaching either one of the two depth notches 38, the set screw 50 can be rotated into engagement with the desired notch 38 and thus the drill bit 20 will be extended and locked into a predetermined position as shown in FIG. 2. The notches 38 can vary in quantity and location so that the extension of the drill bit 20 can be varied to control its drilling depth to accommodate various lengths of anchor screws. As noted earlier, the fit of the drill 20 with the throughbore 60 is such that, while drilling holes, a minimum of wobble will occur.

After drilling of the hole is completed, the drill bit 20 is returned to its retracted position shown in FIGS. 1 and 4 and the screW driver bit 58 is inserted into the hex socket 56 of the driver means 24. As with throughbore 60 and its relationship with drill bit 20, the hex socket 56 is sized so as to minimize the wobbling of the screw driver bit 58 while driving an anchor screw, and such screw driver bit can be retained in hex socket by conventional means as a locking ring, magnetism or friction fit.

Although the invention has been described with respect to a preferred embodiment thereof, it is to be understood that it is not to be so limited since changes and modifications can be made therein which are within the full intended scope of this invention as defined by the appended claims.

I claim:

1. An improved tool adapted for use with a hand drill for installing screw anchors in concrete or masonry walls or the like . comprising:

(a) a sleeve type body having:
  (1) an axial bore with a closed rear end and an open front end;
  (2) a longitudinally aligned open slot in said body;
  (3) at least one depth notch associated with the front portion of said slot.

(b) a handle extending outwardly from the rear end of said body and receivable in the chuck of said drill;

(c) a bit holder slidably located in said bore and having an axial cavity and a bit retention means that extends from one side of said holder through the slot in said body and secures said bit in said cavity such that the sidewalls of said bit holder cavity closely encircle said bit handle;

(d) a drill bit with a handle secured in said bit holder cavity;

(e) a coil spring through which said bit extends and having a rear end that abuts against said bit holder, said spring serving as a bias means to urge said bit in a rearward direction;

(f) a driver means located at the front end of said body and having:
  (1) a head portion with a stair stepped socket; and
  (2) a neck portion positioned in the bore of said body and having a passageway that extends from the bottom of said head socket through said neck portion and opens to said body bore for closely encircling said bit to serve as a bit guide means; and (g) means for securing said driver means to said body.

2. An improved tool as recited in claim 1 wherein said head socket of said drives means has a first recessed portion for receiving a driver bit and a second portion in which the front end of said drill bit can be located without contacting said driver bit.

3. An improved tool as recited in claim 1 wherein said bit holder has a forward protruding collar portion aligned with said cavity and the rear end of said coil spring is seated on said collar to stabilize said end in said body bore.

4. An improved tool as recited in claim 1 wherein the side wall of said bit holder cavity closely encircles a portion of said bit to prevent said bit from wobbling with respect to said holder.

* * * * *